US007781687B2

(12) United States Patent
Scherl et al.

(10) Patent No.: US 7,781,687 B2
(45) Date of Patent: Aug. 24, 2010

(54) CONTROL UNIT WITH A MONITORING APPARATUS

(75) Inventors: Josef Scherl, Neunburg (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 498 days.

(21) Appl. No.: 11/905,017

(22) Filed: Sep. 27, 2007

(65) Prior Publication Data

US 2009/0200145 A1 Aug. 13, 2009

(30) Foreign Application Priority Data

Sep. 28, 2006 (EP) ..... 06020449

(51) Int. Cl.
*H01H 27/00* (2006.01)

(52) U.S. Cl. ..... 200/43.07; 200/50.02; 200/16 D; 200/331; 200/334

(58) Field of Classification Search ..... 200/16 R–16 D, 200/520, 530, 537, 538, 540, 541, 329, 330, 200/331, 334, 341, 43.07, 50.02
See application file for complete search history.

(56) References Cited

U.S. PATENT DOCUMENTS

| | | | | |
|---|---|---|---|---|
| 3,118,026 | A * | 1/1964 | Pusch et al. | 200/16 A |
| 6,198,058 | B1 * | 3/2001 | Graninger et al. | 200/50.02 |
| 6,376,785 | B1 * | 4/2002 | Graninger | 200/50.02 |
| 6,444,932 | B1 | 9/2002 | Resmalm | |
| 6,987,235 | B2 * | 1/2006 | Sambar et al. | 200/520 |
| 7,232,965 | B2 * | 6/2007 | Gibbons et al. | 200/17 R |
| 7,309,840 | B1 * | 12/2007 | Lo | 200/293 |
| 7,488,914 | B2 * | 2/2009 | Kahnert et al. | 200/538 |
| 7,605,337 | B2 * | 10/2009 | Scherl et al. | 200/405 |
| 2006/0214515 | A1 | 9/2006 | Pullmann et al. | |

FOREIGN PATENT DOCUMENTS

| | | |
|---|---|---|
| DE | 41 01 493 | 7/1992 |
| DE | 295 17 718 | 1/1997 |
| DE | 100 47 998 | 3/2001 |
| DE | 203 05 818 | 7/2003 |
| DE | 103 48 884 | 5/2005 |
| DE | 10 2005 010 661 | 9/2006 |
| WO | WO 00/60621 | 10/2000 |

* cited by examiner

*Primary Examiner*—Michael A Friedhofer
(74) *Attorney, Agent, or Firm*—Harness, Dickey & Pierce, P.L.C.

(57) ABSTRACT

A control unit including a monitoring apparatus is disclosed, with the monitoring apparatus having an operating element and an attachment element. In at least one embodiment, the control unit is in two parts and includes an operating unit and switching elements. The required spatial association between the operating unit and the switching element is intended to be monitored in a cost-effective and reliable manner. For this purpose, when the monitoring apparatus is installed correctly, at least one second switching element can be operated by way of an operating member, and a first switching element is operated at the same time by way of the operating element of the monitoring apparatus.

20 Claims, 4 Drawing Sheets

CONTROL UNIT WITH A MONITORING APPARATUS

PRIORITY STATEMENT

The present application hereby claims priority under 35 U.S.C. §119 on European patent application number EP06020449 filed Sep. 28, 2006, the entire contents of which is hereby incorporated herein by reference.

FIELD

Embodiments of the invention generally relate to a control unit with a monitoring apparatus. At least one embodiment relates to a control unit wherein the monitoring apparatus includes an operating element and an attachment element, the attachment element being provided for attachment to a first mounting plate and/or to an operating unit which is mounted on the first mounting plate, with the operating element being provided for operation of a first switching element, which is mounted on a second mounting plate, with the operating unit which is mounted on the first mounting plate being provided for operation of the first switching element by way of an operating plunger, when installed correctly without a monitoring apparatus. Embodiments of the invention also generally relate to a monitoring apparatus for a control unit.

In at least one embodiment, the control unit may be a control switch, for example an emergency-off switch, which has a pot-shaped or mushroom-shaped cap as the operating member. For safety reasons, the cap or the operating member may be firmly connected, for example screwed, to the operating plunger. When the control unit is operated, then the operating plunger of the control unit may be moved from the rest position to the operating position. The operating plunger in this case necessarily interrupts the contacts of at least one break switching element so that the associated circuit, for example of a connected electrical machine, is interrupted. Furthermore, depending on the application, break and/or make switching elements can also be fitted, and are operated jointly by the operating plunger.

For safety reasons, the control unit and its actuating part generally operate on the principle of positive operation, or positive opening.

Alternatively, in at least one embodiment the switching state of the switching elements can also be checked by way of a monitoring appliance, for example by injecting a bit pattern via the closed break contents of the break switching element, and by continuously checking the achieved result. One such monitoring appliance, for example, may be the ASI-F monitoring appliance from the Siemens Company. This appliance is also bus-compatible, so that installation parts which can be accessed for data transmission purposes via a bus can be switched to a safe state in the absence of the expected bit pattern.

The control unit, in at least one embodiment, may also be in two parts. The capability to separate them is necessary in order to allow the control unit to be attached, for example, to a switchgear cabinet door, front panel or switchpanel. For this purpose, by way of example, an operating unit may be passed for installation purposes through a relatively small hole in the switchgear cabinet door or the like, and is connected to it by way of an attachment nut or a clamping ring. The operating plunger can then be attached to the operating member, normally by way of a snap-action or screw connection. In contrast, the live parts which are used in the switching elements can be installed and accommodated safely within the switchgear cabinet. For this purpose, the control unit, in at least one embodiment, may be split into an operating unit and a switching unit, which can be installed separately, but must be joined together spatially precisely for improved or even optimum operation.

BACKGROUND

If the operating plunger is not attached to the operating member correctly, or if the operating unit is not positioned or installed correctly, or the screw connection for the operating plunger has become loose by vibration, then operation of at least one switching element by the operating unit may no longer be ensured, without this being noticeable. In this case, an emergency-off circuit will remain closed, despite operation of the emergency-off switch. The emergency-off switch will therefore lose its functionality and thus its protective function. This also applies in a corresponding manner to control units in general. This can lead to unpredictable damage to people and installation parts in control installations.

DE 103 48 884 discloses a control unit in which spatial association is monitored by way of a transponder, which is fitted to the operating member, and corresponding read unit on the appliance.

DE 203 05 818 discloses a safety element for a control unit, which is in the form of an additional part which can be lead-sealed, with the additional part which can be lead-sealed being located behind the switchgear cabinet door or in the interior of a housing, and being unsuitable for visual or mechanical checking.

SUMMARY

In at least one embodiment, a monitoring apparatus for a control unit is specified, which allows functional checking of the control unit in a safe and cost-effective manner.

At least one embodiment of the invention is also based on the knowledge that transponder-based solutions are quite complex and therefore costly.

At least one embodiment of the invention is directed to a control unit in which, when the monitoring apparatus is installed correctly, at least one second switching element can be operated by way of the operating plunger, and the first switching element is operated at the same time by way of the operating element.

According to at least one embodiment of the invention, the monitoring apparatus, which is provided for use in a control unit, has an operating element and an attachment element. Because of the two-part configurations of the control unit, the operating unit, which is often also referred to simply as an operating member, is mounted on a first mounting plate, in which case the attachment element of the monitoring apparatus, can be attached to the mounting plate and/or to the attached operating element, as a function of the position of the component to be monitored. Those components of the operating unit which are not involved in the operating movement of the operating member are particularly suitable for attachment of the monitoring apparatus.

Furthermore, in at least one embodiment, the control unit has at least one first switching element which is mounted on a second mounting plate. This first switching element forms the second part of the control unit, possibly together with further switching elements. When the user operates the operating member of the control unit, then the operating member transmits the operating movement to the operating plunger. The operating plunger is in turn provided for operation of the first and/or of the second and/or of the further switching elements which may be provided.

When the monitoring apparatus of at least one embodiment is installed correctly, the first switching element may be operated permanently by way of the operating element of the monitoring apparatus. In this case, the second and any other further switching elements which may be provided can still be operated by the operating plunger. In contrast, the first switching element may have a new function, specifically functional monitoring of the installed control unit. An installation error of the operating unit in the first mounting plate or of the switching elements on the second mounting plate, as regards incorrect positioning of the mounting plates with respect to one another can therefore be detected by way of the first switching element. Malfunctions which occur during use of the control unit, such as loss of position as a result of vibration movement, can likewise be detected.

The monitoring apparatus, in at least one embodiment, can advantageously be used in conventional control units since a switching element which is already provided in the control unit is used for position checking, in conjunction with the monitoring apparatus. The first switching element monitors a circuit which is used to identify a fault. By way of example, this can be done by way of an optical signal so that the user can tell at a glance whether the control unit is serviceable or unserviceable.

In one advantageous embodiment, the first switching element is provided for opening and closing a monitoring circuit, thus allowing multiple use.

In one advantageous embodiment, the monitoring apparatus is provided for identification of the relative position of at least the second switching element with respect to the operating unit, for functional monitoring of the control unit and/or for installation checking of the control unit. The monitoring process therefore extends to the installation phase and to the in-use phase of the control unit. Furthermore, positions of components which do not belong to the control unit can also be checked. This guarantees optimum safety conditions for the fitter and user.

In one advantageous embodiment, the monitoring apparatus is in two parts, with a first part being a first attachment part, and a second part being a second attachment part. In a two-part embodiment, the operating depth of the monitoring apparatus can be varied, for example making it possible to use it in control units of different size, or else consideration can be given to the dimensions of the housing by the capability to vary the distances between the switching elements and the operating unit.

In one advantageous embodiment, the first and/or the second mounting plate can respectively be attached to a first or a second housing part, and respectively form at least one first housing part and/or one second housing part. In simpler configurations, it is worthwhile installing the control unit directly in the housing, thus saving components and material. On the other hand, in more complex appliances, it is worthwhile installing the control unit by way of at least one mounting plate, so that the choice of housing remains flexible.

BRIEF DESCRIPTION OF THE DRAWINGS

Further advantageous embodiments and preferred developments of the invention can be found in the description of example embodiments including the figures.

The invention will be described and explained in more detail in the following text with reference to the example embodiments which are illustrated in the figures, in which.

DETAILED DESCRIPTION OF THE EXAMPLE EMBODIMENTS

Figure 1:
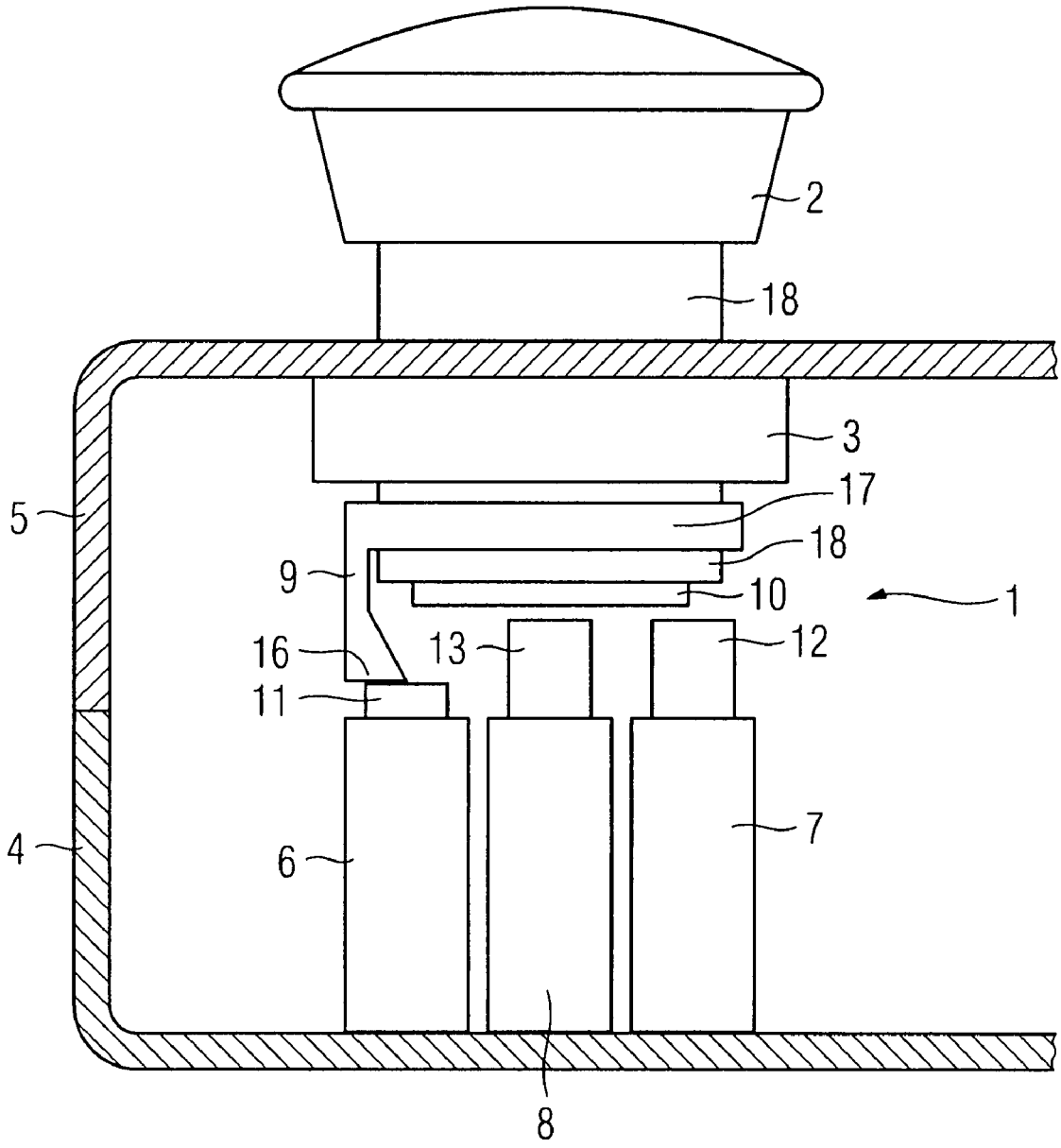
FIG. 1 shows an installed emergency-off switch with a monitoring apparatus.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

Figure 2:
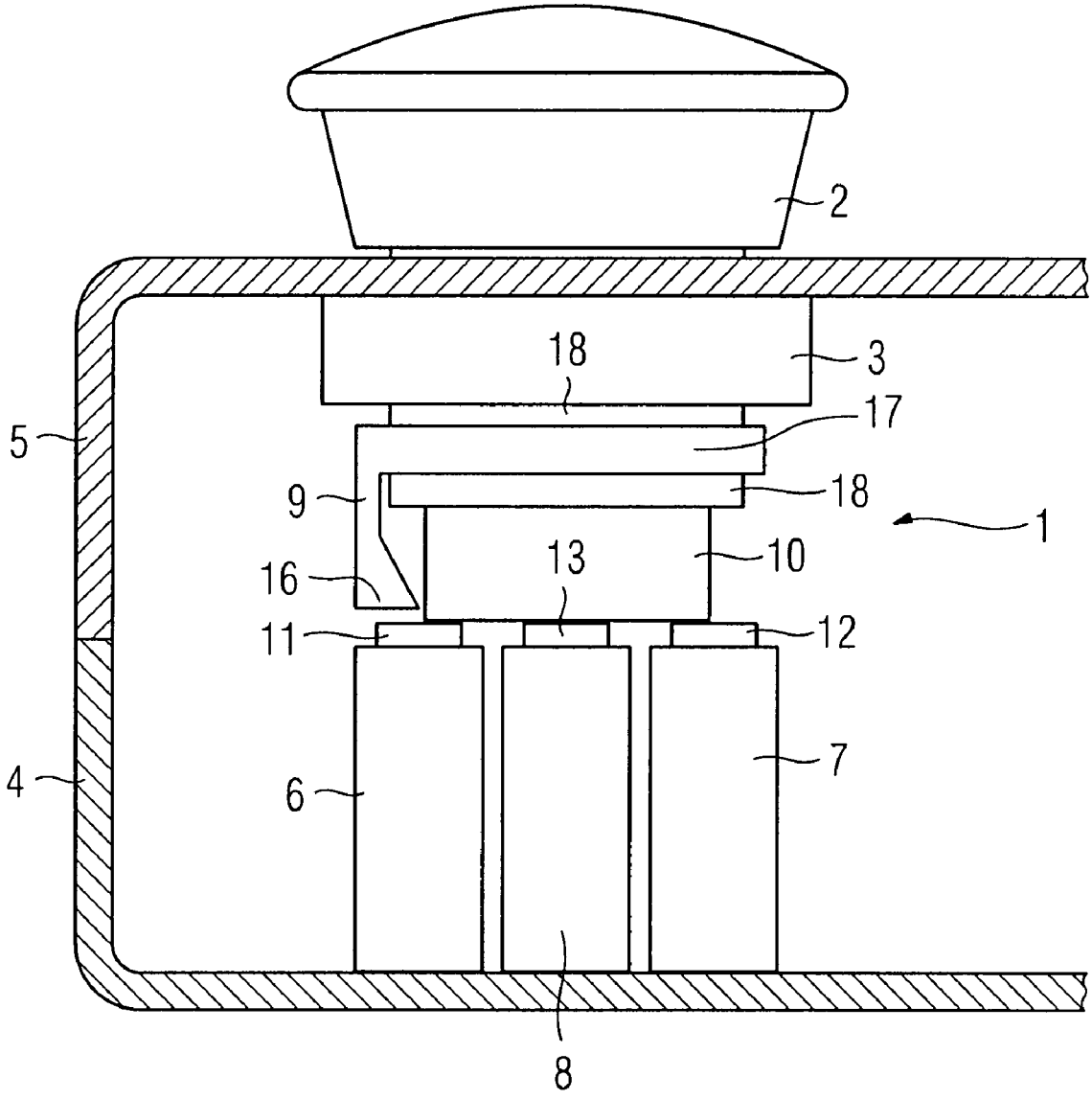
FIG. 2 shows the emergency-off switch from FIG. 1 in the operated state.

FIG. 1 and FIG. 2 show an installed emergency-off switch 1 with a monitoring device 9, with the emergency-off switch 1 being unoperated in FIG. 1, and being operated in FIG. 2.

The monitoring apparatus 9 is shown in both figures and has an operating element 16 and an attachment element 17. The operating element 16 holds the switching element slide 11 in the operated position. The associated first switching element 6 is therefore provided for functional and position monitoring, and indicates correct installation of the emergency-off switch 1. The operating plunger 10 is directly connected to the operating member 2, for example via a screw connection, such that the operating member 2 can be used to operate a second switching element 8 and a third switching element slide 7 via their switching-element slides 13, 12. Although the operating plunger 10 is also provided for operation of the switching element slide 11 of the first switching element 6, the switching state of the first switching element 6 is not changed during the operating process.

In the case of encapsulated control units, as in the case of this emergency-off switch 1 as well, the switching elements 6, 8, 7 are snapped or screwed into the housing lower part 4.

The switching element 6 is also operated by the operating element 16 of the monitoring apparatus 9 only when the switching units, which are generally installed as a block, the operating unit and the housing plates 4, 5 are correctly installed.

In this example embodiment, the first housing part is in the form of a housing upper part 5. The second housing part is correspondingly in the form of a housing lower part 4.

It is sensible to fit the monitoring apparatus 9 by way of the attachment element 17 on the guide 18, which belong to the elements of the emergency-off switch 1 which cannot be moved. The operating unit is attached to the housing upper part 5 by way of an attachment part 3, such as a ring nut.

It may be advantageous for the monitoring apparatus 9 to be a component of the operating apparatus, of the operating member 2, of the attachment part 3, of the housing upper part 5 or of a separate part. The monitoring apparatus 9 is in this case appropriately connected to the respectively mentioned component and does not influence the interlocking operating movement of the switching-element slides 12, 13.

It is advantageous that no specific monitoring switching elements are required, with just one or more conventional switching elements, which are present in any case, being used. This characteristic likewise makes it possible to retrofit control units in existing installations and machines.

The example embodiment represents a particularly reliable and economic solution, since it is mechanical and requires no evaluation electronics for monitoring. Furthermore, a corresponding monitoring apparatus can be used in other control units, for example in push buttons, selection switches or similar switches. Furthermore, the user is free to choose whether he wishes to use break or make switching elements, or a combination of both. This applies not only to the first switching element 6 but also to the second and third switching elements 7, 8.

The monitoring circuit which is switched by the first switching element 6 can likewise be used highly variably. The corresponding signal can be converted as required for control purposes, and audible and/or visual alarms can be used, or else shutdown would be feasible. Signaling to a control center can likewise easily be provided by way of the monitoring circuit.

In addition to an implementation of an additional mechanical interlocking or force-fitting security against shaking of the operating unit, the monitoring apparatus 9 can also advantageously be used as a mechanical orientation aid and for protection against incorrect assembly of the modular control unit and its installation within a housing.

Figure 3:
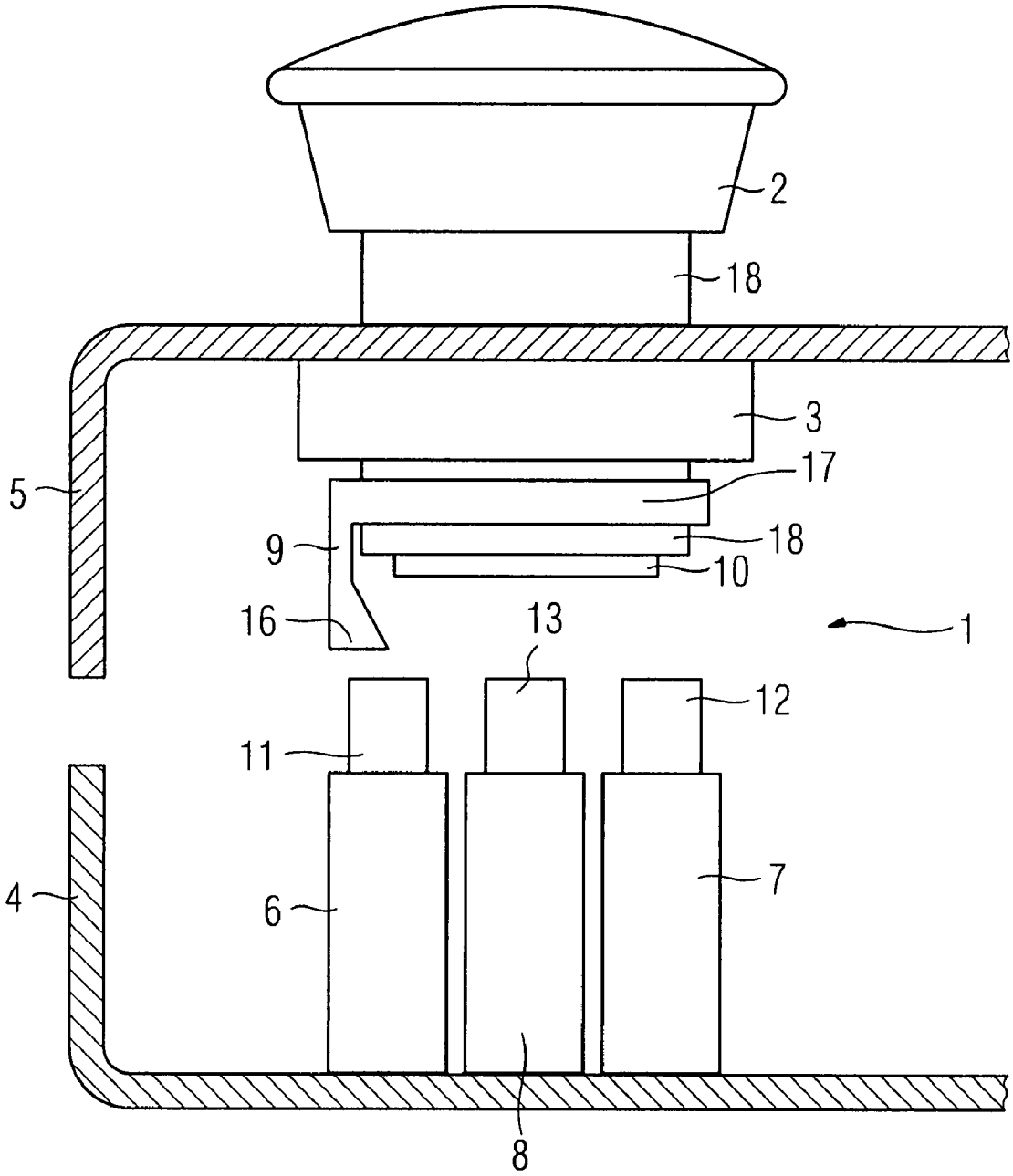
FIG. 3 shows the emergency-off switch from FIG. 1 in an installed state.

FIG. 3 shows the emergency-off switch 1 from FIG. 1, in the installed state.

The operating unit and the switching elements 6, 8, 7 are already installed on the housing upper part 5 or on the housing lower part 4. As can be seen, correct installation, which also includes correct connection of the housing parts 4, 5, results in the required spatial association between the operating unit and the switching elements 7, 8, 6.

If the housing upper part 5 with the operating unit mounted in it is moved away (for example as a consequence of screws becoming loose), then the monitoring apparatus 9 is also moved away from the first switching element 6, which carries out the function of a monitoring switching element, thus releasing the switching element slide 11, in contrast to the previous figures. Beyond a certain distance, the first switching element 6 changes its switching state. A signal relating to the switching state change is then used in a control system for a machine or installation to produce a safe state, and/or to generate an alarm or a signal.

The monitoring apparatus 9 and the switching point of the first switching element 6 are advantageously matched such that the signal is produced by the first switching element 6 before the operating unit has moved so far away from the switching elements 7, 8 that, for example, it would no longer be possible for it to be operated correctly in an emergency.

In contrast to signals which are not generated mechanically (for example from a transponder), the signal from the mechanical switching element 6 can also be processed without any problems by conventional control systems, such as those normally used for simple machines or installations. In this sense, the first switching element 6 can be connected in parallel or in series with other contacts in the control system as required, in order to initiate the necessary measures (for example shut down, alarm) when a signal is produced. In this example embodiment, the first switching element 6 is physically identical to the other switching elements 7, 8, although, in other embodiments, it is also possible to use different types of mechanical contacts, for example microswitches, for monitoring the spatial association. In this case, a combination of different switching elements is likewise feasible.

If all or a plurality of the operating units can be monitored by a monitoring apparatus 9 and the associated monitoring switching element on the housing upper part 5 which, for example, is in the form of a switchgear cabinet door and is fitted with a plurality of control units, this ensures that incorrect association between the operating units and the switching elements associated with them is detected even if the switchgear cabinet door is opened on one side.

Furthermore, different alarms can be generated, which detect incorrect association or multiple incorrect association. By far the simplest implementation would presumably be to connect the switching elements being monitored in series, thus resulting in a (single) alarm signal being generated in the event of any incorrect association. However, identification of specific incorrect associations can also be notified by way of different alarm signals.

If a positively open switching element 6 is used, this advantageously ensures that the circuit is safely interrupted, and remains interrupted, in the event of physical separation of a monitoring switching element and the first switching element 6. However, it is not just possible to detect physical separation but also incorrect or changed association between the switching elements and the associated operating units, thus making it possible, for example, to detect a distorted switchgear cabinet door.

As a separate part, the monitoring apparatus 9 is advantageously provided to hold the operating unit at least in the housing upper part 5 if it is inadvertently released from the housing upper part 5, even though it is no longer in the correct position. A corresponding situation applies to mounting walls, mounting plates or other housing parts.

Figure 4:
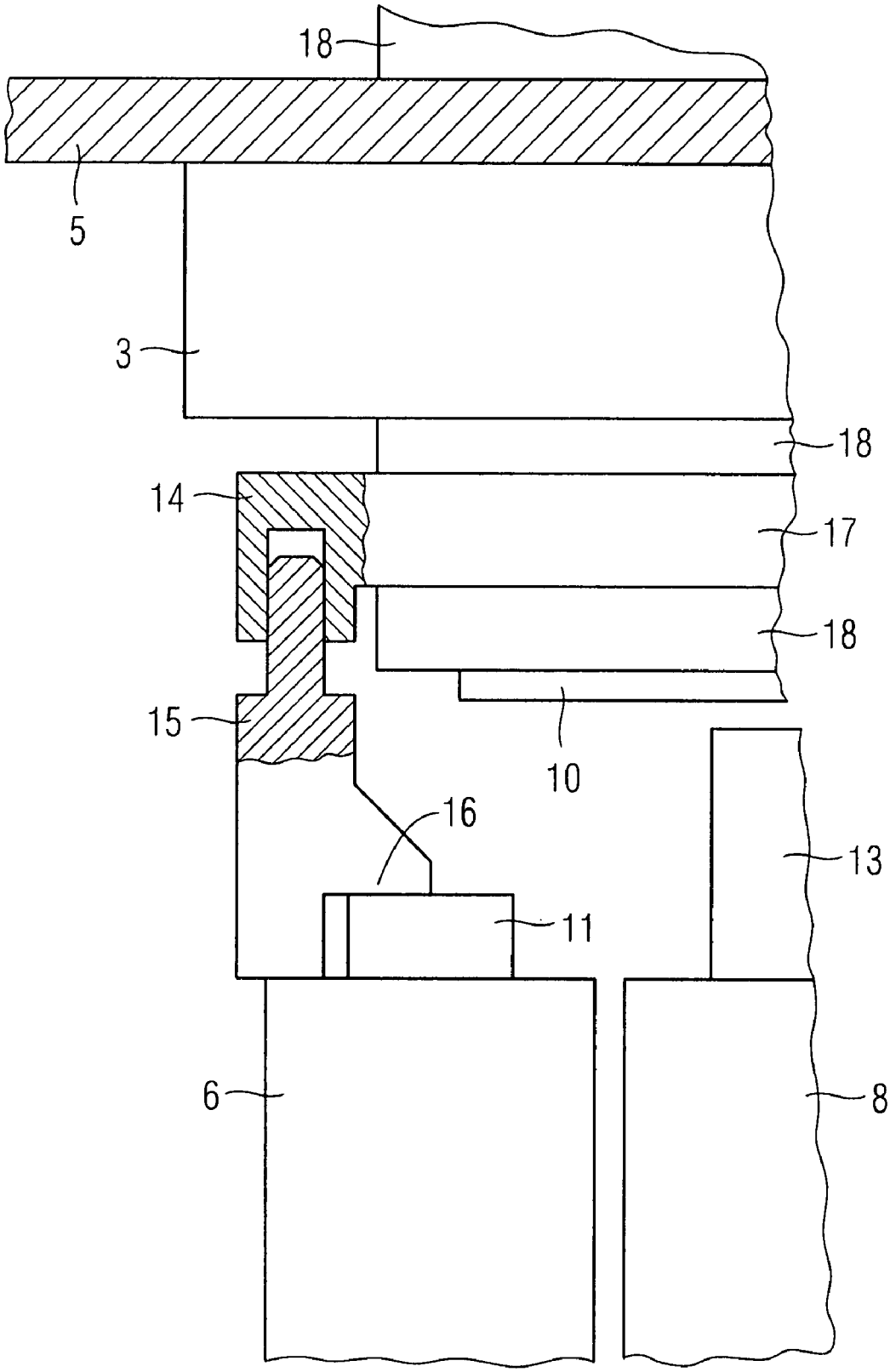
FIG. 4 shows a two-part monitoring apparatus in an emergency-off switch.

FIG. 4 shows a two-part monitoring apparatus which can replace the monitoring apparatus 9 for the emergency-off switch 1 in FIG. 1.

The monitoring apparatus is composed of two parts, with a first attachment part 14 having the attachment element 17, and with a second attachment part 15 having the operating element 16. The two parts can be pushed one inside the other, and different connections are feasible for the two-part solution.

The first attachment part 14 and the second attachment part 15 can advantageously be adjusted with respect to one another, for example by way of an adjusting screw which is not shown, in which case, the tripping time of the first switching element 6 in the event of the operating unit becoming loose can be defined by the distance between the two parts. It is also feasible for the switching elements 6, 7, 8 to be able to assume a different relative position with respect to the operating element during operation, by way of flexible length adjustment.

In one advantageous embodiment, self-adjustment is provided for the first and second attachment parts 14, 15 relative to one another. For example, a catch could be provided at the pin-like end, which is inserted into the first attachment part 14, of the second attachment part 15, and is intended to define the distance between the two parts when corresponding force is applied during installation. In this case, it is important for the restoring force which the switching element slide 11 applies to the second attachment part 15 not to be sufficient to move the second attachment part 15 further into the first attachment part 14. Different attachment mechanisms are also feasible, which allow the second attachment part 15 to be inserted into the first attachment part 14, but prevent the first attachment part 14 from being removed from the second attachment part 15 once it has been inserted, for example in conjunction with barbs.

In particular upon closure of the housing parts 4, 5, or when they are screwed together, the self-adjustment in this case automatically results in the second attachment part 15 and the first switching element 6 being associated without any clearance, and therefore optimally. Once the adjustment process that has been mentioned has been completed, the association between the first attachment part 14 and the second attachment part 15 forms a quasi-rigid system by way of a force and/or interlock.

In summary, at least one embodiment of the invention relates to a control unit with a monitoring apparatus, with the monitoring apparatus having an operating element and an attachment element. Furthermore, in at least one embodiment the control unit may be in two parts and include an operating unit and switching elements. The required spatial association between the operating unit and the switching elements is intended to be monitored cost-effectively and safely. For this purpose, when the monitoring apparatus is installed correctly, at least one second switching element can be operated by way of an operating number, and a first switching element at the same time operates the monitoring apparatus, by way of the operating element.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A control unit, comprising:

a monitoring apparatus, the monitoring apparatus including an operating element and an attachment element, the attachment element being provided for attachment to at least one of a first mounting plate and an operating unit mounted on the first mounting plate, the operating element being provided for operation of a first switching element mounted on a second mounting plate, wherein when the monitoring apparatus is installed correctly in the control unit, at least one second switching element is operatable by way of an operating plunger and the first switching element is operatable at the same time by way of the operating element.

2. The control unit as claimed in claim 1, wherein the first switching element is provided for at least one of opening and closing a monitoring circuit.

3. The control unit as claimed in claim 2, wherein correct operation at least of the second switching element is monitorable.

4. The control unit as claimed in claim 2, wherein the monitoring apparatus is provided for operation of the first switching element only when installed correctly.

5. The control unit as claimed in claim 2, wherein the monitoring apparatus is provided for detection of at least one of correct installation and correct position of at least one of the operating unit, the first mounting plate, the second mounting plate and the switching elements.

6. The control unit as claimed in claim 2, wherein the monitoring apparatus is provided for at least one of identification of the relative position of at least the second switching element with respect to the operating element, functional monitoring of the control unit, and installation monitoring of the control unit.

7. The control unit as claimed in claim 2, wherein the monitoring apparatus is in two parts, with a first attachment part and a second attachment part.

8. The control unit as claimed in claim 2, wherein at least one of the first and second mounting plate is at least one of respectively attachable to a first housing part or a second housing part, and respectively form a first housing part or a second housing part.

9. The control unit as claimed in claim 2, wherein the control unit is at least one of a circuit breaker, a safety switch, a push-button switch, a selection switch and an emergency-off switch.

10. The control unit as claimed in claim 1, wherein correct operation at least of the second switching element is monitorable.

11. The control unit as claimed in claim 1, wherein the monitoring apparatus is provided for operation of the first switching element only when installed correctly.

12. The control unit as claimed in claim 1, wherein the monitoring apparatus is provided for detection of at least one of correct installation and correct position of at least one of the operating unit, the first mounting plate, the second mounting plate and the switching elements.

13. The control unit as claimed in claim 1, wherein the monitoring apparatus is provided for at least one of identification of the relative position of at least the second switching element with respect to the operating element, functional monitoring of the control unit, and installation monitoring of the control unit.

14. The control unit as claimed in claim 1, wherein the monitoring apparatus is in two parts, with a first attachment part and a second attachment part.

15. The control unit as claimed in claim 1, wherein at least one of the first and second mounting plate is at least one of respectively attachable to a first housing part or a second housing part, and respectively form a first housing part or a second housing part.

16. The control unit as claimed in claim 1, wherein the control unit is at least one of a circuit breaker, a safety switch, a push-button switch, a selection switch and an emergency-off switch.

17. The control unit as claimed in claim 1, wherein the operating unit mounted on the first mounting plate is provided for operation of the first switching element by way of the operating plunger, when it is installed correctly in the control unit without the monitoring apparatus.

18. A monitoring apparatus comprising:

an operating element and an attachment element for installation in a control unit, the attachment element being provided for attachment to at least one of a first mounting plate and an operating unit mounted on the first mounting plate, the operating element being provided for operation of a first switching element mounted on the second mounting plate, wherein when the control unit is installed correctly with a monitoring apparatus, at least one second switching element being operatable by way of an operating plunger and the first switching element being operatable at the same time by way of the attachment element.

19. A control unit including the monitoring apparatus as claimed in claim 18.

20. The monitoring apparatus of claim 18, wherein the operating element mounted on the first mounting plate is provided for operation of the first switching element by way of the operating plunger when it is installed correctly in the control unit without a monitoring apparatus.

* * * * *